United States Patent [19]

Fujimoto et al.

[11] Patent Number: 4,913,120

[45] Date of Patent: Apr. 3, 1990

[54] AIR-FUEL RATIO FEEDBACK CONTROL METHOD FOR INTERNAL COMBUSTION ENGINES

[75] Inventors: Sachito Fujimoto; Shuichi Hosoi, both of Wako, Japan

[73] Assignee: Honda Giken Kogyo K.K., Tokyo, Japan

[21] Appl. No.: 321,261

[22] Filed: Mar. 9, 1989

[30] Foreign Application Priority Data

Mar. 18, 1988 [JP] Japan ..... 63-65323

[51] Int. Cl.[4] ..... F02D 41/14

[52] U.S. Cl. ..... 123/489; 123/492

[58] Field of Search ..... 123/440, 489, 492

[56] References Cited

U.S. PATENT DOCUMENTS

| | | | |
|---|---|---|---|
| 4,089,313 | 5/1978 | Asano et al. | 123/440 |
| 4,187,812 | 2/1980 | Hosaka et al. | 123/489 X |
| 4,744,345 | 5/1988 | Yamato | 123/492 X |
| 4,796,589 | 1/1989 | Fujimoto et al. | 123/440 X |

*Primary Examiner*—Tony M. Argenbright

*Attorney, Agent, or Firm*—Arthur L. Lessler

[57] ABSTRACT

An air-fuel ratio feedback control method for an internal combustion engine, in which when the engine is operating in a feedback control region, the air-fuel ratio of an air-fuel mixture being supplied to the engine is controlled by the use of a correction coefficient varying in response to the output of an exhaust gas ingredient concentration sensor arranged in the exhaust system of the engine. When the engine has shifted to a predetermined high load region within the feedback control region, in which the rate of change in values of an engine operating parameter is larger than a predetermined value, the air-fuel ratio feedback control is effected by the use of a first average value of the correction coefficient, calculated when the engine is in the predetermined high load region. When the engine has shifted to a second predetermined region within the feedback control region other than the predetermined high load region, the feedback control is effected by the use of a second average value of the correction coefficient, calculated in the second predetermined region, in a manner different from that of calculating the first average value.

7 Claims, 5 Drawing Sheets

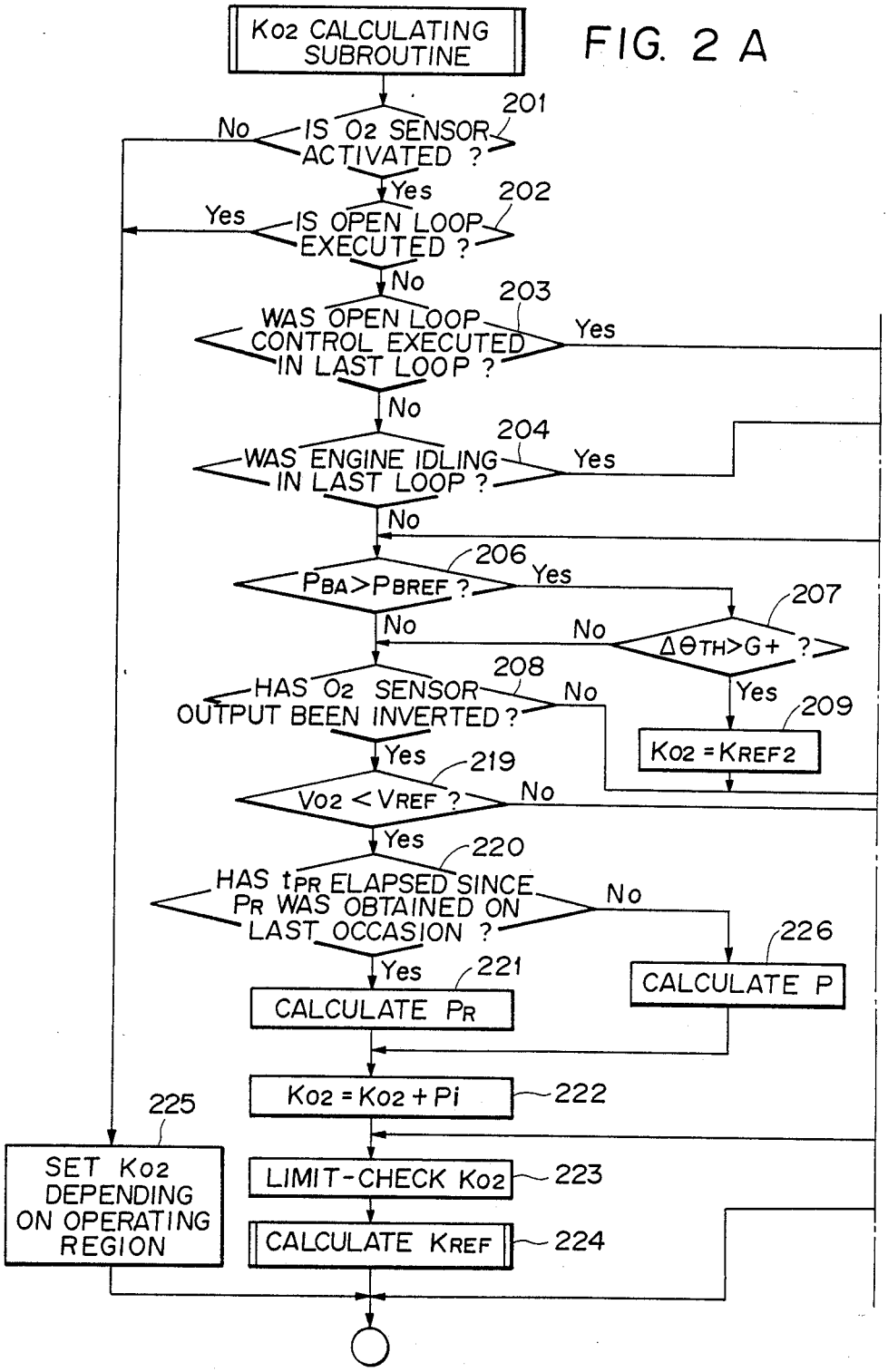
Ko2 CALCULATING SUBROUTINE
FIG. 2 A
201
IS O2 SENSOR ACTIVATED ?
No
Yes
202
IS OPEN LOOP EXECUTED ?
Yes
No
203
WAS OPEN LOOP CONTROL EXECUTED IN LAST LOOP ?
Yes
No
204
WAS ENGINE IDLING IN LAST LOOP ?
Yes
No
206
PBA>PBREF ?
Yes
No
207
ΔθTH>G+ ?
No
Yes
208
HAS O2 SENSOR OUTPUT BEEN INVERTED ?
No
Yes
209
Ko2 = KREF2
219
Vo2 < VREF ?
No
Yes
220
HAS tPR ELAPSED SINCE PR WAS OBTAINED ON LAST OCCASION ?
No
Yes
221
CALCULATE PR
226
CALCULATE P
Ko2 = Ko2 + Pi
222
225
SET Ko2 DEPENDING ON OPERATING REGION
LIMIT-CHECK Ko2
223
CALCULATE KREF
224

IS ENGINE IDLING IN PRESENT LOOP ?
WAS KO2 HELD IN LAST LOOP ?
IS ENGINE IDLING ?
θTH > θIDL ?
TW > TWCL ?
KO2 = CR x KREF1
KO2 = KREF1
KO2 = CL x KREF0
KO2 = KREF0
HOLD KO2
VO2 < VREF ?
CALCULATE P
KO2 = KO2 - P
NIL = NIL + 1
NIL = NI ?
KO2 = KO2 + Δk
NIL = 0
NIH = NIH + 1
NIH = NI ?
KO2 = KO2 - Δk
NIH = 0
HOLD KO2
Yes
No
205
210
211
212
213
214
215
216
217
218
227
228
229
230
231
232
233
234
235
236
237
238

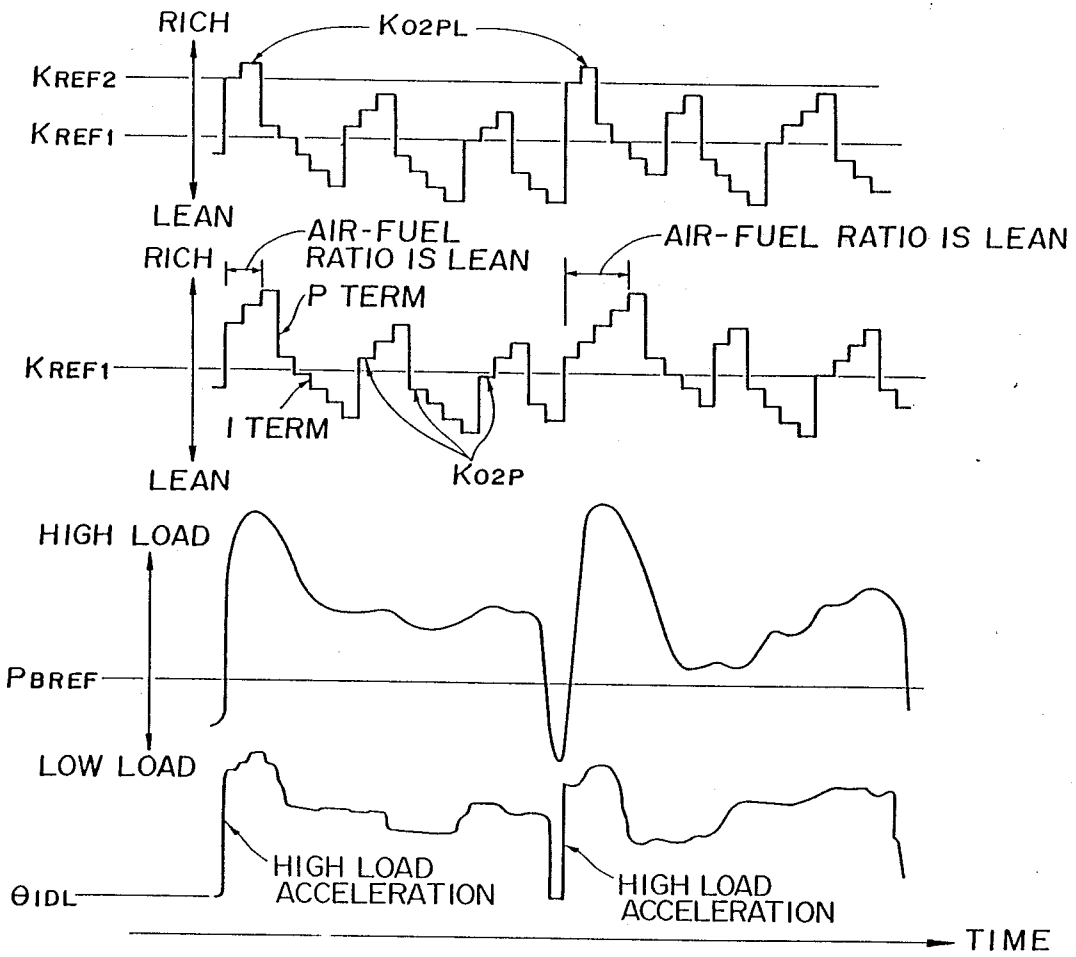
FIG. 4(a) $K_{O2}$ OBTAINED BY THE PRESENT INVENTION
FIG. 4(b) $K_{O2}$ OBTAINED BY CONVENTIONAL METHOD
FIG. 4(c) $P_{BA}$
FIG. 4(d) $\theta_{TH}$

AIR-FUEL RATIO FEEDBACK CONTROL METHOD FOR INTERNAL COMBUSTION ENGINES

BACKGROUND OF THE INVENTION

The present invention relates to a method of feedback-controlling the air-fuel ratio of an air-fuel mixture being supplied to an internal combustion engine, and more particularly to a method of this kind which is adaped to properly control the air-fuel ratio when the engine is accelerated under high load.

An air-fuel ratio feedback control method for internal combustion engines is known, e.g. from Japanese Provisional Patent Publication (Kokai) No. 62-157252 owned by the assignee of the present application, in which the air-fuel ratio of an air-fuel mixture being supplied to an internal combustion engine is controlled by the use of a correction coefficient varying in response to the output of an exhaust gas ingredient (e.g. oxygen) concentration sensor arranged in the exhaust system of the engine during operation in a predetermined air-fuel ratio feedback control region. An average value of values of the correction coefficient assumed during engine operation in the predetermined air-fuel ratio feedback control region is calculated and applied to air-fuel ratio feedback control which is carried out later.

According to the above proposed method, the feedback control region is divided into an idling region and regions other than the idling region (hereinafter called "off-idling region") including an accelerating region in which the engine is accelerated from the idling region to start the vehicle from a standing state (standing-acceleration). Average values of the correction coefficient are respectively calculated during engine operation in these divided regions and stored. The stored average values are applied in place of the correction coefficient when the operating region of the engine has shifted to the respective regions. The application of the average value in the above accelerating region is intended to prevent the air-fuel ratio of the mixture from being leaned at the standing-acceleration of the engine, due to adhesion of fuel injected from fuel injection valves of the engine to the inner wall surface of the intake pipe at the start of standing-acceleration, to thereby reduce the amount of emission of NOx.

Although the proposed method can prevent leaning of the air-fuel mixture at the time of standing-acceleration, it shows the following disadvantages if it is applied when the engine is accelerated under high load within the feedback control region, e.g., when the driver accelerates the engine in order to pass a vehicle during running of the vehicle (high load acceleration).

Also at high load acceleration of the engine, especially in the case that the accelerator pedal is abruptly stepped on, fuel becomes stuck to the inner wall surface of the intake pipe to cause leaning of the air-fuel ratio. In the feedback control according to the conventional method, the amount of fuel being supplied to the engine is increased or decreased at a relatively small rate by integral control, so long as the output of the exhaust gas ingredient concentration sensor remains on the same side with respect to a predetermined reference value, i.e. either smaller or larger than the predetermined reference value, that is, until it changes across the predetermined reference value. Consequently, the air-fuel ratio continues to be lean for a long time during the high load acceleration. Therefore, an increase in the emission of NOx cannot be prevented.

Further, by effecting the feedback control during the high load acceleration as above, the correction coefficient is varied in such a direction as to enrich the air-fuel ratio, and an average value of the correction coefficient for the off-idling region is calculated by the use of thus varied values thereof. As a result, the calculated average value is accordingly varied in such a direction as to enrich the air-fuel ratio. Consequently, if the average value is applied when the engine has shifted to a condition other than the high load accelerating condition, e.g. a steady condition in which the vehicle is cruising, the air-fuel ratio is enriched, resulting in increased emission of HC and CO. Thus, according to the above conventional method, if the high load acceleration is frequently carried out, the emission characteristics of the engine can be degraded, not only when the engine operating condition is shifted to the high load accelerating condition, but also when it is shifted e.g. to a steady condition in which the vehicle is cruising.

SUMMARY OF THE INVENTION

It is therefore the object of the invention to provide an air-fuel ratio feedback control method for internal combustion engines which is capable of controlling the air-fuel ratio of the air-fuel mixture to a proper value, not only at the standing-acceleration of the engine, but also at the high load acceleration thereof, or also when the high load acceleration and steady operation are frequently alternately repeated.

To attain the object, there is provided a method of effecting feedback control of the air-fuel ratio of an air-fuel mixture being supplied to an internal combustion engine having an exhaust system, and a sensor arranged in the exhaust system for sensing the concentration of an ingredient in exhaust gases from the engine, wherein when the engine is operating in a feedback control region, the air-fuel ratio of the mixture is controlled by the use of a correction coefficient varying in response to an output of the sensor.

The method of the invention is characterized by comprising the following steps:

(1) detecting a rate of change in the value of an operating parameter of the engine;

(2) determining whether or not the engine is operating in a predetermined operating region which is a high load operating region within the feedback control region, and in which the rate of change in the value of the operating parameter is larger than a predetermined value;

(3) calculating an average value of values of the correction coefficient assumed during operation of the engine in the predetermined operating region, and storing the calculated average value when the engine is in the predetermined operating region; and (4) effecting the feedback control of the air-fuel ratio by the use of the average value in place of the correction coefficient, when the engine has shifted to the predetermined operating region.

Preferably, the method further includes the steps of:

(5) calculating a second average value of values of the correction coefficient assumed during operation of the engine in a second predetermined operating region within the feedback control region other than the first-mentioned predetermined operating region, in a manner different from a manner of calculating the first-mentioned average value, and storing the second average value, when the engine is in the second predetermined operating region; and (6) effecting the feedback control of the air-fuel ratio by the use of the second average value in place of the correction coefficient, when the engine has shifted to the second predetermined operating region.

More preferably, the step (3) comprises the steps of:

(3*a*) when the engine is in the predetermined operating region, effecting the feedback control of the air-fuel ratio by proportional control when the output of the sensor has been inverted, and by integral control when the output of the sensor has not been inverted; and (3*b*) calculating the average value of values of the correction coefficient by the use of a value of the correction coefficient assumed immediately before operation of the proportional control is effected, and storing the calculated average value.

The first-mentioned average value of the correction coefficient may be calculated by the use of a value of the correction coefficient assumed immediately before operation of the proportional control is effected, and the second average value calculated while the engine is in the second predetermined region.

The second average value of the correction coefficient may be calculated by the use of a value of the correction coefficient assumed immediately after operation of the proportional control is effected, and the second average value.

The first-mentioned predetermined operating region may be a region in which absolute pressure within the intake passage is higher than a predetermined value and a rate of change in the opening of the throttle valve as the aforementioned operating parameter is larger than a predetermined value.

The above and other objects, features, and advantages of the invention will be more apparent from the ensuing detailed description taken in conjunction with the accompanying drawings.

BRIEF DESCRIPTION OF THE DRAWINGS

FIGS. 4(*a–d*) are a diagram illustrating control characteristics according to a conventional method and the method of the invention.

DETAILED DESCRIPTION

The method according to the invention will now be described in detail with reference to the drawings showing an embodiment thereof.

Figure 1:
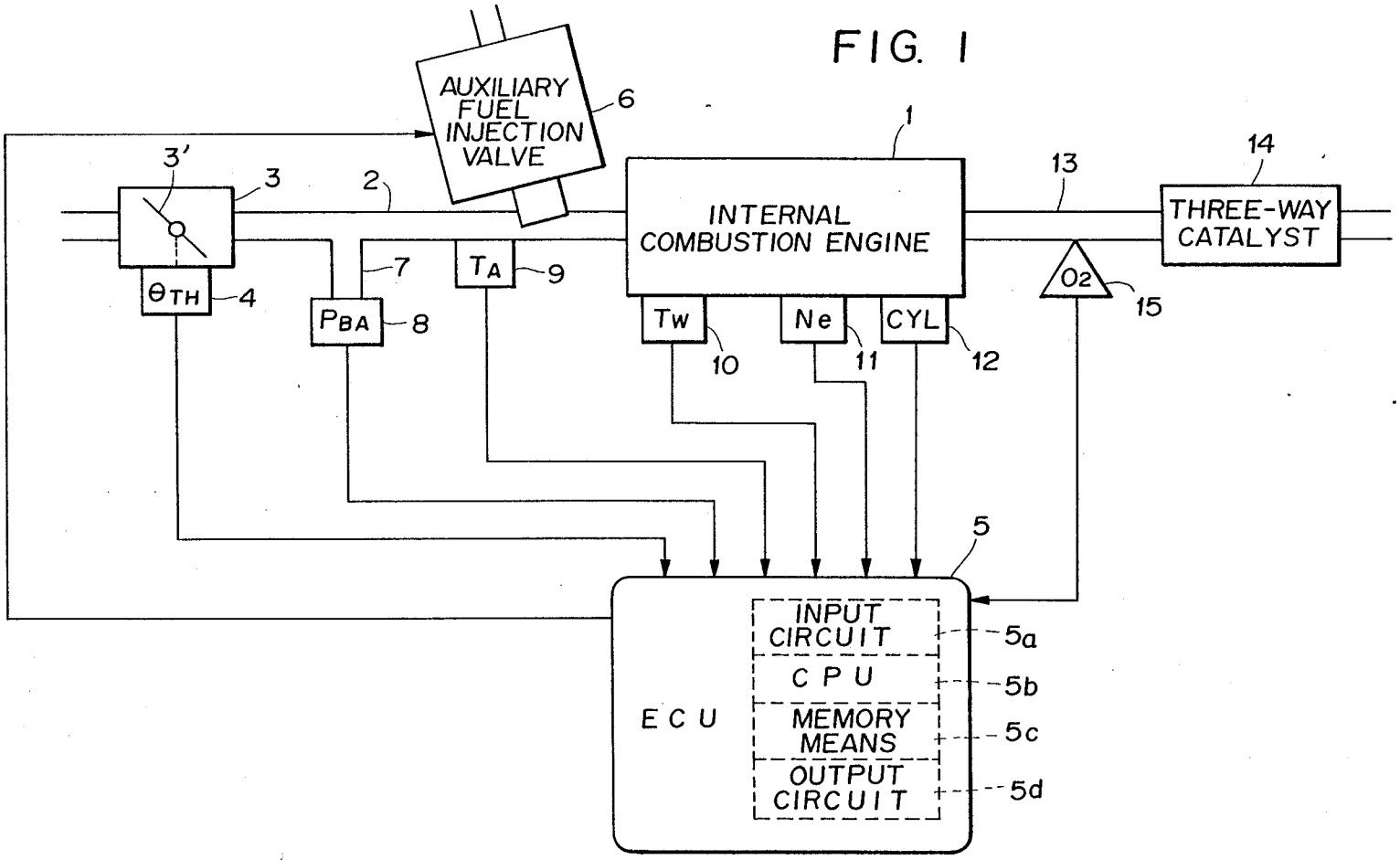
FIG. 1 is a block diagram illustrating the whole arrangement of a fuel supply control system for carrying out the method of the invention.

Referring first to FIG. 1, there is shown the whole arrangement of a fuel supply control system for an internal combustion engine, which is adapted to carry out the method according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the intake pipe at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 at a location immediately downstream of the throttle valve 3' for supplying an electric signal indicative of the sensed absolute pressure within the intake pipe 2 to the ECU 5. An intake air temperature ($T_A$) sensor 9 is inserted into the intake pipe 2 at a location downstream of the intake pipe absolute pressure sensor 8 for supplying an electric signal indicative of the sensed intake air temperature $T_A$ to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas ingredient concentration sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration to the ECU 5.

The ECU 5 comprises an input circuit **5*a* having functions of shaping the waveforms of input signals from various sensors, shifting the voltage levels of output signals from analog output sensors to a predetermined level, converting the level-shifted analog signals to digital signals, and so forth, a central processing unit (hereinafter called "the CPU") 5*b*, memory means 5*c* storing various operational programs which are executed in the CPU 5*b* and for storing results of calculations therefrom, etc., and an output circuit 5*d* which outputs driving signals to the fuel injection valves 6**.

The CPU **5*b* operates in response to the above-mentioned signals from the sensors to determine operating conditions in which the engine 1 is operating such as the air-fuel ratio feedback control region and open-loop control regions, and calculates, based upon the determined operating conditions, the valve opening period or fuel injection period $T_{OUT}$ over which the fuel injection valves 6 are to be opened, by the use of the following equation in synchronism with inputting of TDC signal pulses to the ECU 5**.

$$T_{OUT}=T_i\times K_{O2}\times K_1+K_2 \quad (1)$$

where $T_i$ represents a basic value of the fuel injection period $T_{OUT}$ of the fuel injection valves 6, which is determined based upon the engine rotational speed Ne and the intake pipe absolute pressure $P_{BA}$, for example.

Figures 2, 2A, 2B:
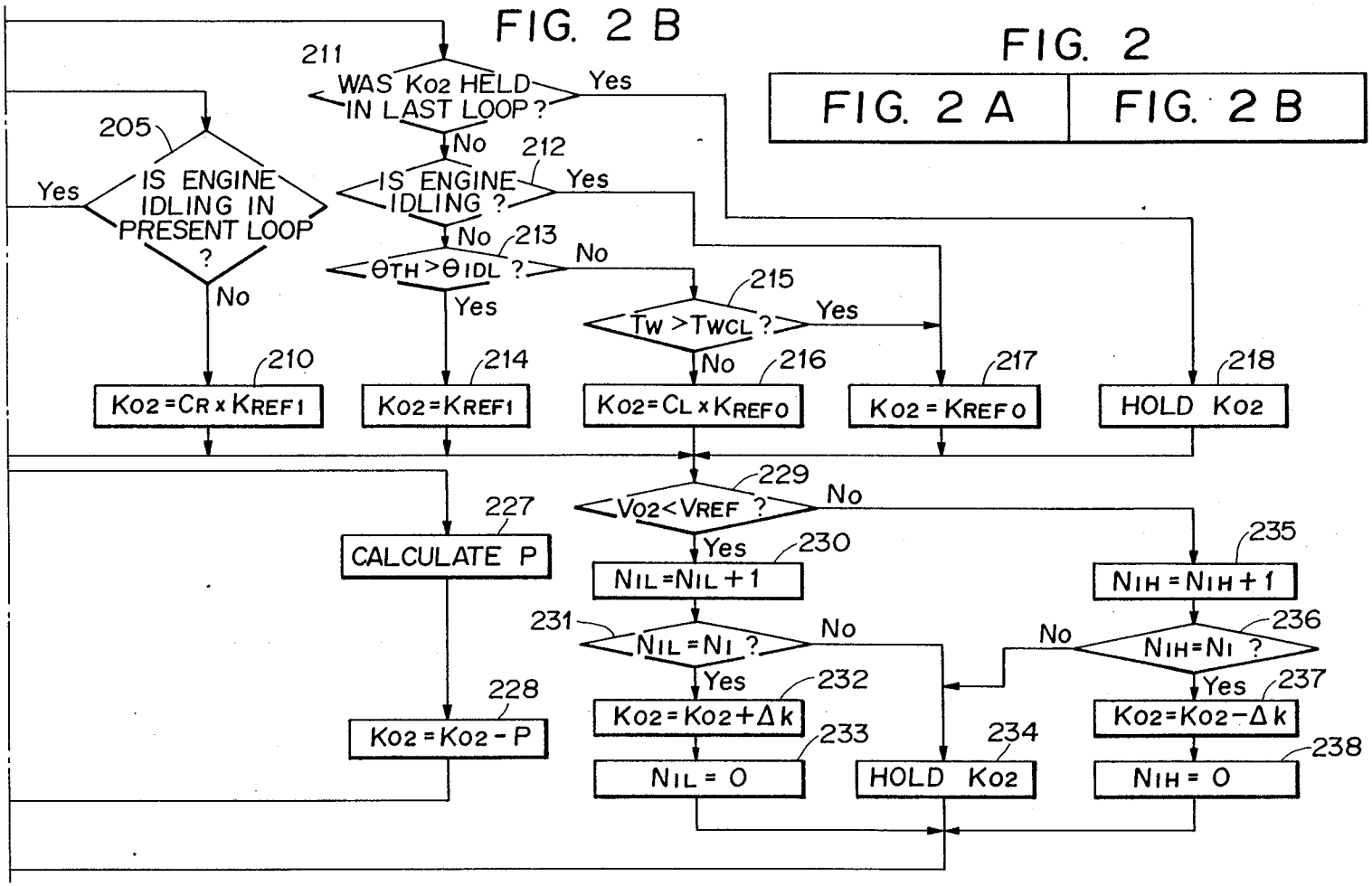
FIGS. 2, 2A and 2B are a flowchart of a subroutine for calculating a value of correction coefficient $K_{O2}$ used in the air-fuel ratio feedback control.

$K_{O2}$ is an air-fuel ratio feedback control correction coefficient whose value is determined in response to the oxygen concentration in the exhaust gases by means of a program shown in FIG. 2, during feedback control, while it is set to respective predetermined appropriate values while the engine is in predetermined operating regions (the open-loop control regions) other than the feedback control regions.

$K_1$ and $K_2$ are other correction coefficients and correction variables, respectively, which are calculated based on various engine operating parameter signals to such values as to optimize characteristics of the engine such as fuel consumption and accelerability depending on operating conditions of the engine.

The CPU 5b supplies through the output circuit 5d the fuel injection valves 6 with driving signals corresponding to the calculated fuel injection period $T_{OUT}$ determined as above, over which the fuel injection valves 6 are opened.

FIG. 2 shows a subroutine for calculating the air-fuel ratio feedback control correction coefficient $K_{O2}$. This program is carried out in synchronism with inputting of each TDC signal pulse to the ECU 5.

First, it is determined at a step 201 whether or not the $O_2$ sensor 15 has been activated. If the answer is Yes, that is, if the $O_2$ sensor 15 has been activated, it is determined at a step 202 whether or not the engine is operating in one of the open-loop control regions. If the answer to the question of the step 201 is No, that is, if the $O_2$ sensor 15 has not been activated, or if the answer to the question of the step 202 is Yes, that is, if the engine is operating in one of the open-loop control regions, the correction coefficient $K_{O2}$ is set to a value corresponding to the one open-loop control region at a step 225, followed by terminating the present program.

If the answer to the question of the step 202 is No, that is, if the engine is operating in the feedback control region, it is determined at a step 203 whether or not open-loop control was carried out in the last loop. If the answer is Yes, it is determined at a step 211 whether or not the value of the correction coefficient $K_{O2}$ was held at an immediately preceding value in the last loop. If the answer is Yes, the value of the correction coefficient $K_{O2}$ is held at the immediately preceding value (step 218), and integral control (I-term control) is carried out at steps 229 et seq., described hereinafter.

If the answer to the question of the step 211 is No, that is, if the value of the correction coefficient $K_{O2}$ was not held in the last loop, it is determined at a step 212 whether or not the engine is operating in an idling region within the feedback control region.

It is determined that the engine is operating in the idling region e.g. when the engine rotational speed Ne is lower than a predetermined value, and at the same time whether or not the throttle opening $\theta_{TH}$ is smaller than a predetermined value.

If the answer to the question of the step 212 is Yes, that is, if the engine is operating in the idling region, the correction coefficient $K_{O2}$ is set to an average value $K_{REF0}$ for the idling region which was calculated while the engine was in the idling region within the feedback control region, as hereinafter described, at a step 217. Then, steps 229 et seq. are executed to carry out integral control of the air-fuel ratio, as hereinafter described.

If the answer to the question of the step 212 is No, that is, if the engine is operating in a region within the feedback control region other than the idling region, i.e. the off-idling region, it is determined at a step 213 whether or not the throttle valve opening $\theta_{TH}$ is greater than a predetermined value $\theta_{IDL}$, e.g. 2 degrees. If the answer is Yes, the correction coefficient $K_{O2}$ is set, at a step 214, to $K_{REF1}$ for the off-idling region, an average value of values of $K_{O2}$ assumed while the engine is operating in the off-idling region, which value is calculated in such a manner as described hereinafter, followed by integral control at steps 229 et seq.

If the answer to the question of the step 213 is No, that is, if $\theta_{TH}\leqq\theta_{IDL}$, it is determined at a step 215 whether or not the engine coolant temperature $T_W$ is higher than a predetermined value $T_{WCL}$ (e.g. 70° C). If the answer is Yes, that is, if $T_W>T_{WCL}$, and therefore the engine coolant temperature $T_W$ is not in a low temperature range, the program proceeds to a step 217.

If the answer to the question of the step 215 is No, that is, if $T_W\leqq T_{WCL}$ stands (the engine is in a cold condition), the correction coefficient $K_{O2}$ is set to a product $C_L\times K_{REF0}$ obtained by multiplying the average value $K_{REF0}$ for the idling region by a predetermined leaning value $C_L$ at a step 216, followed by execution of the integral control in the steps 229 et seq. The predetermined leaning value $C_L$ is set at a value smaller than 1.0 so that the correction coefficient $K_{O2}$ is made smaller than the average value $K_{REF0}$ assumed when the engine coolant temperature $T_W$ is not low, whereby when the engine coolant temperature is low the feedback control in the off-idling region is initiated with the correction coefficient $K_{O2}$ set to such a small initial value as to lean the air-fuel ratio, thus reducing emission of CO and HC in the exhaust gases.

If the answer to the question of the step 203 is No, that is, if feedback control was carried out in the last loop, it is determined at a step 204 whether or not the engine was operating in the idling region in the last loop. If the answer is Yes, it is further determined at a step 205 whether or not the engine is operating in the idling region in the present loop. If the answer is No, the correction coefficient $K_{O2}$ is set, at a step 210, to a product $C_R\times K_{REF1}$ obtained by multiplying the average value $K_{REF1}$ for the off-idling region by a predetermined enriching value $C_R$, followed by execution of the integral control at the step 229 et seq. The predetermined enriching value $C_R$ is set at a value larger than 1.0, so that the value $K_{O2}$ is made larger than the value $K_{REF1}$. Thus, when the engine has shifted from the idling region to the off-idling region, the initial value of $K_{O2}$ is set to a richer value, to thereby prevent an increase in the amount of emission of NOx.

If the answer at the step 204 is No, that is, if the engine was operating in the off-idling region in the last loop, or if the answer at the step 205 is Yes, that is, if the engine is operating in the idling region in the present loop, similarly in the last loop, it is determined at a step 206 whether or not the absolute pressure $P_{BA}$ is higher than a predetermined value $P_{BREF}$, e.g. 400 mHg. If the answer is Yes, it is determined at a step 207 whether or not the valve opening rate $\Delta\theta_{TH}$ of the throttle valve 3' is larger than a predetermined value G+, e.g. 30°. If the answer is Yes, that is, if the engine is being accelerated under high load (high load acceleration) within the off-idling region, the correction coefficient $K_{O2}$ is set, at a step 209, to an average value $K_{REF2}$ calculated, as hereinafter described, based upon values of $K_{O2}$ assumed when the engine was in the high load acceleration, followed by execution of integral control at the step 229 et seq. In this way, when the engine is the high load acceleration, that is, when the absolute pressure $P_{BA}$ is larger than the predetermined value $P_{BREF}$, and at the same time the throttle valve opening rate $\Delta\theta_{TH}$ is larger than the predetermined rate G+, the initial value of $K_{O2}$ is set to the average value $K_{REF2}$ calculated on the last occasion in which the engine was in the high load acceleration, to start the integral control at the step 229 et seq., so that the amount of emission of NOx can be prevented from being increased.

If the answer at the step 206 or 207 is No, i.e. if $P_{BA} \leqq P_{BREF}$ or $\Delta\theta_{TH} \leqq G+$, it is determined at a step 208 whether or not the output level of the $O_2$ sensor 15 has been inverted. If the answer is No, the integral control is effected at the step 229 et seq.

At the step 229, it is determined whether or not the output voltage $V_{O2}$ is lower than a predetermined reference voltage $V_{REF}$, which is set at an approximately middle value, e.g. 0.55 V, of the output $V_{O2}$ range that can be assumed when the $O_2$ sensor 15 is activated. If the answer is Yes at the step 229, i.e. if $V_{O2} < V_{REF}$, a value of 1 is added to $N_{IL}$, a counted number of pulses of the TDC signal, at a step 230, and it is determined at a step 231 whether or not the counted pulse number $N_{IL}$ has reached a predetermined value $N_I$. If the answer is No, the correction coefficient $K_{O2}$ is held at an immediately preceding value at a step 234, while if the answer is Yes, a predetermined value $\Delta k$ is added to the coefficient $K_{O2}$ at a step 232, and the counted pulse number is reset to 0 at a step 233. In this way, whenever the counted pulse number $N_{IL}$ reaches the predetermined value $N_I$, the coefficient $K_{O2}$ is increased by the predetermined value $\Delta k$.

Thus, so long as the output voltage $V_{O2}$ of the $O_2$ sensor 15 is lower than the reference voltage $V_{REF}$, that is, so long as the air-fuel ratio continues to be lean, the correction coefficient $K_{O2}$ is increased by the predetermined value $\Delta k$ whenever the counted pulse number $N_{IL}$ reaches the predetermined value $N_I$ to thereby enrich the air-fuel ratio.

In the meanwhile, if the answer to the question of the step 229 is No, i.e. if $V_{O2} \geqq V_{REF}$, a value of 1 is added to $N_{IH}$, a counted number of pulses of the TDC signal, at a step 235, and it is determined at a step 236 whether or not the counted pulse number $N_{IH}$ has reached the predetermined value $N_I$. If the answer is No, the correction coefficient $K_{O2}$ is held at an immediately preceding value at the step 234, while if the answer is Yes, the predetermined value $\Delta k$ is subtracted from the coefficient $K_{O2}$ at a step 237, and the counted pulse number $N_{IH}$ is reset to 0 at a step 238. In this way, whenever the counted pulse number $N_{IH}$ reaches the predetermined value $N_I$, the correction coefficient $K_{O2}$ is decreased by the predetermined value $\Delta k$.

Thus, so long as the output voltage $V_{O2}$ is equal to or higher than the reference voltage $V_{REF}$, that is, so long as the air-fuel ratio continues to be rich, the correction coefficient $K_{O2}$ is decreased by the predetermined value $\Delta k$ whenever the counted pulse number $N_{IH}$ reaches the predetermined value $N_I$ to thereby lean the air-fuel ratio.

If the answer to the question of the step 208 is Yes, that is, if the output level of the $O_2$ sensor 15 has been inverted, proportional control (P-term control) is carried out in the following steps. First, it is determined at a step 219 whether or not the output voltage $V_{O2}$ of the $O_2$ sensor 15 is lower than the reference voltage $V_{REF}$. If the answer is Yes, i.e. if $V_{O2} < V_{REF}$, it is determined at a step 220 whether or not a predetermined period of time $t_{PR}$ has elapsed after a second correction value $P_R$, which will be referred to hereinafter, was applied on the last occasion. This predetermined period of time $t_{PR}$ is provided to maintain constant the frequency of application of the second correction value $P_R$ throughout the entire engine rotational speed range. To this end, the time period $t_{PR}$ is set to smaller values as the engine rotational speed Ne becomes higher. If the answer to the question of the step 220 is Yes, a value of the second correction value $P_R$ corresponding to the engine rotational speed Ne is read from an Ne—$P_R$ table, at a step 221, while if the answer is No, a value of a first correction value P corresponding to the engine rotational speed Ne is read from an Ne—P table, at a step 226. Values of the first correction value P within the Ne—P table are smaller than respective corresponding ones of the second correction value $P_R$ within the Ne—$P_R$ table. Then, a correction value $P_i$, i.e. the read first correction value P or the read second correction value $P_R$, is added to the correction coefficient $K_{O2}$, at a step 222. Thus, if the output level of the $O_2$ sensor 15 has been inverted and at the same time the output voltage $V_{O2}$ after the invertion is lower than the reference voltage $V_{REF}$, it is judged that the air-fuel ratio has been changed from a rich state to a lean state, and then the correction value P or $P_R$ corresponding to the engine rotational speed Ne is added to the correction coefficient $K_{O2}$ to thereby enrich the air-fuel ratio.

In the meanwhile, if the answer to the question of the step 219 is No, i.e. if $V_{O2} \geqq V_{REF}$, similarly to the step 226, a value of the first correction value P corresponding to the engine rotational speed Ne is read from the Ne—P table, at a step 227, and the first correction value P is subtracted from the correction coefficient $K_{O2}$ at a step 228. Thus, if the output level of the $O_2$ sensor 15 has been inverted and at the same time the output voltage $V_{O2}$ after the invertion is equal to or higher than the reference voltage $V_{REF}$, it is judged that the air-fuel ratio has been changed from a lean state to a rich state, and then the correction value P corresponding to the engine rotational speed Ne is subtracted from the correction coefficient $K_{O2}$ to thereby lean the air-fuel ratio.

Then, limit checking of a value of the correction coefficient $K_{O2}$ set at the proportional control is carried out at a step 223. More specifically, it is checked that the calculated value of the correction coefficient $K_{O2}$ is within a predetermined range. If the correction coefficient $K_{O2}$ is outside the predetermined range, it is held at the lower or upper limit value of the predetermined range.

Figure 3:
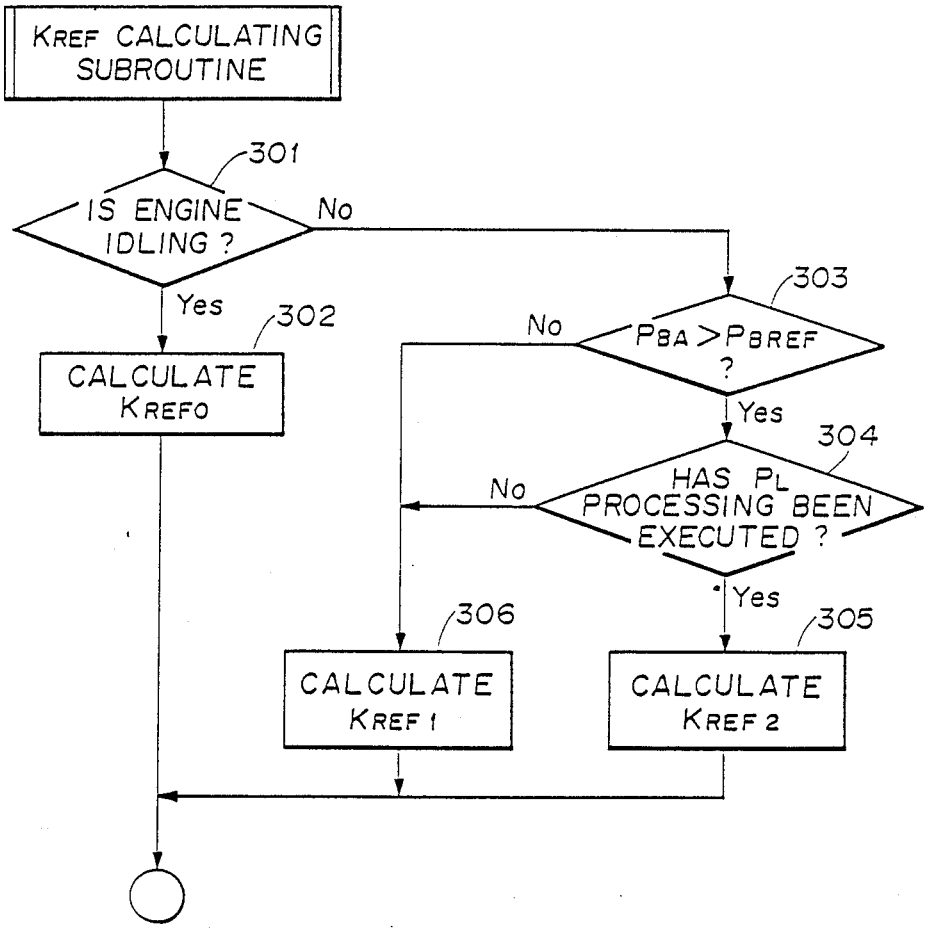
FIG. 3 is a flowchart of a subroutine for calculating an average value $K_{REF}$ of the correction coefficient $K_{O2}$.

The value of the correction coefficient $K_{O2}$ thus set is applied to calculation of an average value $K_{REF}$ at a step 224 in accordance with the program shown in FIG. 3, and the calculated average value $K_{REF}$ is stored into the memory, followed by terminating the present program.

Referring to FIG. 3, it is first determined at a step 301 whether or not the engine is operating in the idling region. If the answer is Yes, the average value $K_{REF0}$ of $K_{O2}$ for the idling region is calculated, at a step 302, by the use of an equation (2), as hereinafter referred to, followed by terminating the present program. If the answer is No, that is, if the engine is operating in the off-idling region, it is determined at a step 303 whether or not the intake pipe absolute pressure $P_{BA}$ is higher than the predetermined value $P_{BREF}$. If the answer is Yes, that is, if $P_{BA} > P_{BREF}$ holds, indicating that the engine is in a high load operating condition, it is determined at a step 304 whether or not $P_L$ processing (i.e. subtraction of the first correction value P from $K_{O2}$ at the step 228 in FIG. 2) has been executed after the throttle valve opening rate $\Delta\theta_{TH}$ exceeded the predetermined value G+. If the answer is Yes, the average value $K_{REF2}$ of $K_{O2}$ for the high load accelerating region is calculated, at a step 305, by the use of an equation (3), as hereinafter referred to, followed by terminating the present program.

If the answer at the step 303 or 304 is No, that is, if $P_{BA} \leqq P_{BREF}$ holds or the $P_L$ processing has not been effected after $\Delta\theta_{TH} > G+$ held, the average value $K_{REF1}$ of $K_{O2}$ for the off-idling region is calculated, at a step 306, by the use of the equation (3), followed by terminating the present program.

In this way, if the engine is in the high load accelerating region, in which the $P_L$ processing has been executed after $P_{BA} > P_{BREF}$ and $\Delta\theta_{TH} > G+$ held, the average value $K_{REF2}$ for the high load accelerating region is calculated, whereas if $P_{BA} > P_{BREF}$ holds, and if the $P_L$ processing has not been executed, the average value $K_{REF1}$ for the off-idling region is calculated.

The average value $K_{REF0}$ for the idling region and the average value $K_{REF1}$ for the off-idling region are calculated by the use of the following equation (2):

$$K_{REFi} = K_{O2P} \times (C_{REFi}/A) + K_{REFi'} \times (A - C_{REFi})/A \quad (2)$$

where $K_{REFi}$ represents $K_{REF0}$ or $K_{REF1}$, $K_{O2P}$ a value of $K_{O2}$ assumed immediately after the proportional (P-term) control operation is effected, A a constant, and $C_{REFi}$ representing $C_{REF0}$ or $C_{REF1}$, which is a calibration variable set to a value selected from values 1 − A. $K_{REFi'}$ represents $K_{REF0'}$ or $K_{REF1'}$, which is an average value of $K_{O2}$ assumed, up to the last occasion, in the same region as the engine is operating in the present loop. The constant A is set, for example, to 256 when calculating $K_{REF0}$, while it is set to 65536 when calculating $K_{REF1}$.

The average value $K_{REF2}$ of $K_{O2}$ for the high load accelerating region is calculated by the use of the following equation (3):

$$K_{REF2} = K_{O2PL} \times (C_{REF2}/A) + K_{REF1'} \times (A - C_{REF2})/A \quad (3)$$

where $K_{O2PL}$ represents a value of $K_{O2}$ assumed immediately before the $P_L$ processing is done after $\Delta\theta_{TH} > G+$ holds, $C_{REF2}$ a calibration variable set to a value selected from values 1 − A, and $K_{REF1'}$ an average value of $K_{O2}$ values for the off-idling region assumed up to the last occasion. The constant A is set, for example, to 65536.

Since the ratio of $K_{O2P}$ or $K_{O2PL}$ to $K_{REFi}$ or $K_{REF2}$ at the P-term control operation varies depending upon the value of $C_{REFi}$ or $C_{REF2}$, the value of $C_{REFi}$ or $C_{REF2}$ is set to a suitable value within the range of 1 − A in dependence upon an air-fuel ratio control system or an engine to be employed, in order to obtain the optimal value of $K_{REF}$ (i.e. $K_{REF0}$, $K_{REF1}$ or $K_{REF2}$).

How the correction coefficient $K_{O2}$ is controlled to vary by the fuel supply control system, to which the method of the invention is applied, will now be described with reference to FIG. 4.

(d) of FIG. 4 shows an example of change in the throttle valve opening $\theta_{TH}$ during operation of the engine. When the throttle valve 3' is suddenly largely opened under a high load accelerating condition of the engine as shown in (d) of FIG. 4, the intake pipe absolute pressure $P_{BA}$ suddenly increases, then decreases with a rise in the engine rotational speed, and thereafter varies in response to the throttle valve opening $\theta_{TH}$, as shown in (c) of FIG. 4.

According to the conventional method, the correction coefficient $K_{O2}$ is varied in response to a change in the intake pipe absolute pressure $P_{BA}$ and the throttle valve opening $\theta_{TH}$, as shown in (b) of FIG. 4. In the figure, abrupt changes in the value of $K_{O2}$ have been caused by the proportional control, while stepwise changes in the $K_{O2}$ value have been caused by the integral control. Values of $K_{O2}$ assumed immediately after the proportional control operation is effected are substituted into the equation (2) as $K_{O2P}$ to calculate the average value $K_{REF1}$ of $K_{O2}$ for the off-idling region. According to the conventional method, in the high load accelerating region of the engine, the coefficient $K_{O2}$ is gradually increased by the integral control after it is increased by the proportional control, which causes leaning of the air-fuel ratio of the mixture in the high load accelerating region. Further, a value of $K_{O2P}$ assumed during the high load acceleration becomes larger than that assumed in other cases, and therefore if such high load acceleration is frequently carried out, the average value $K_{REF1}$ becomes a richer value, resulting in enrichment of the air-fuel ratio of the mixture in an operating region of the engine, to which $K_{REF1}$ is applied, e.g. the feedback control region immediately following the open loop control region.

On the other hand, according to the invention, if the engine is in the high load accelerating condition, that is, if $P_{BA} > P_{BREF}$ and $\Delta\theta_{TH} > G+$, the average value $K_{REF2}$ of $K_{O2}$ for the high load accelerating region is applied. As stated before, $K_{REF2}$ is an average value calculated, by the use of the equation (3), based upon $K_{O2PL}$, which is a value of $K_{O2}$ assumed immediately before the $P_L$ processing in the high load accelerating region, that is, the largest value of $K_{O2}$ in the same region, as well as upon the average value $K_{REF1'}$ of $K_{O2}$ values for the off-idling region obtained up to the last occasion. Consequently, by applying $K_{REF2}$ in the high load accelerating region leaning of the air-fuel ratio can be prevented to suppress an increase in the emission of NOx in the exhaust gases. Further, since, as stated before, $K_{O2PL}$ assumed in the high load accelerating region is not applied to calculate the average value $K_{REF1}$ of $K_{O2}$ for the off-idling region, even if the high load acceleration is frequently carried out, the average value $K_{REF1}$ does not assume a richer value to thereby prevent enriching of the air-fuel ratio of the mixture when $K_{REF1}$ is applied.

What is claimed is:

1. A method of effecting feedback control of the air-fuel ratio of an air-fuel mixture being supplied to an internal combustion engine having an exhaust system, and a sensor arranged in said exhaust system for sensing the concentration of an ingredient in exhaust gases from said engine, wherein when said engine is operating in a feedback control region, the air-fuel ratio of said mixture is controlled by the use of a correction coefficient varying in response to an output of said sensor, the method comprising the steps of:

(1) detecting a rate of change in the value of an operating parameter of said engine;

(2) determining whether or not said engine is operating in a predetermined operating region which is a high load operating region within said feedback control region, and in which the rate of change in the value of said operating parameter is larger than a predetermined value;

(3) calculating an average value of values of said correction coefficient assumed during operation of said engine in said predetermined operating region, and storing the calculated average value when said engine is in said predetermined operating region; and (4) effecting the feedback control of the air-fuel ratio by the use of said average value in place of said correction coefficient, when said engine has shifted to said predetermined operating region.

2. A method as claimed in claim 1, further including the steps of:

(5) calculating a second average value of values of said correction coefficient assumed during operation of said engine in a second predetermined operating region within said feedback control region other than said first-mentioned predetermined operating region, in a manner different from a manner of calculating said first-mentioned average value, and storing said second average value, when said engine is in said second predetermined operating region; and (6) effecting the feedback control of the air-fuel ratio by the use of said second average value in place of said correction coefficient, when said engine has shifted to said second predetermined operating region.

3. A method as claimed in claim 1, wherein said step (3) comprises the steps of:

(3a) when said engine is in said predetermined operating region, effecting the feedback control of the air-fuel ratio by proportional control when the output of said sensor has been inverted, and by integral control when the output of said sensor has not been inverted; and (3b) calculating said average value of values of said correction coefficient by the use of a value of said correction coefficient assumed immediately before operation of the proportional control is effected, and storing the calculated average value.

4. A method as claimed in claim 3, wherein said first-mentioned average value of said correction coefficient is calculated by the use of a value of said correction coefficient assumed immediately before operation of the proportional control is effected, and said second average value calculated while said engine is in said second predetermined region.

5. A method as claimed in any of claims 1, 2, or 4, wherein said engine has an intake passage, and a throttle valve arranged in said intake passage, said operating parameter of said engine being the opening of said throttle valve.

6. A method as claimed in claim 5, wherein said first-mentioned predetermined operating region is a region in which absolute pressure within said intake passage is higher than a predetermined value and a rate of change in the opening of said throttle valve is larger than a predetermined value.

7. A method as claimed in claim 3, wherein said second average value of said correction coefficient is calculated by the use of a value of said correction coefficient assumed immediately after operation of the proportional control is effected, and said second average value.

* * * * *